US009409094B1

(12) United States Patent
Wulf et al.

(10) Patent No.: US 9,409,094 B1
(45) Date of Patent: Aug. 9, 2016

(54) SLIDE SYSTEM

(71) Applicants: David M. Wulf, Salt Lake City, UT (US); Taylor Gourley, Salt Lake City, UT (US); John Malfatto, Salt Lake City, UT (US); Brandon Jay, Eagle Mountain, UT (US)

(72) Inventors: David M. Wulf, Salt Lake City, UT (US); Taylor Gourley, Salt Lake City, UT (US); John Malfatto, Salt Lake City, UT (US); Brandon Jay, Eagle Mountain, UT (US)

( * ) Notice: Subject to any disclaimer, the term of this patent is extended or adjusted under 35 U.S.C. 154(b) by 0 days.

(21) Appl. No.: 14/611,899

(22) Filed: Feb. 2, 2015

(51) Int. Cl.
*A63G 21/18* (2006.01)
*A63B 69/00* (2006.01)

(52) U.S. Cl.
CPC ..... *A63G 21/18* (2013.01)

(58) Field of Classification Search
CPC ..... A63G 21/00; A63G 21/18; A63G 31/00; A63G 31/007; A63B 69/0093; A63B 2009/006; A63B 2009/008
USPC ..... 472/13, 116–117, 128, 129; 104/55, 69, 104/70
See application file for complete search history.

(56) References Cited

U.S. PATENT DOCUMENTS 4,943,048 A * 7/1990 Hentges ..... A63G 21/00 182/49
5,154,671 A * 10/1992 Smollar ..... A63G 21/18 472/117
6,062,983 A * 5/2000 Butsook ..... A63G 21/18 4/488
6,758,231 B1 * 7/2004 Lochtefeld ..... A63G 3/00 104/70
7,066,821 B2 * 6/2006 Langford ..... A63G 21/18 472/117
D562,929 S * 2/2008 Fitzgerald ..... D21/819
7,361,096 B2 * 4/2008 Sanchez ..... A63G 21/18 472/117

OTHER PUBLICATIONS

PCT/US2016/016180, Notification of Transmittal of the International Search Report and the Written Opinion of the International Searching Authority, or the Declaration, PCT International Searching Authority, Mar. 25, 2016, 8 pages.

* cited by examiner

*Primary Examiner* — Kien Nguyen
(74) *Attorney, Agent, or Firm* — Kunzler Law Group

(57) ABSTRACT

The slide system includes a plurality of slide segments that are detachably and longitudinally inter-coupled, each slide segment having a length, a width, and a sliding surface. The slide system also includes a plurality of transverse arches, each transverse arch spanning at least a portion of the width of one of the slide segments. Still further, the slide system includes a water distribution subsystem that has a water supply interface that is coupleable in water receiving communication with a water source and water routing lines that are coupled in water receiving communication with the water supply interface. The water routing lines are coupled to the plurality of transverse arches and comprise outlets that distribute water transversely across at least the portion of the width of the sliding surface of the slide segments.

18 Claims, 8 Drawing Sheets

SLIDE SYSTEM

FIELD

This invention relates to slides and more particularly relates to water slide systems.

BACKGROUND

Conventional amusement rides and conventional amusement attractions generally allow users/riders to personally experience a thrilling and exhilarating ride. While certain types of amusement rides are well-suited for repeated relocation and reuse (e.g., fair and carnival rides), most amusement rides that involve water systems are generally permanently installed at a certain location. Most of the time it would be impractical, if not impossible, to repeatedly relocate, re-assemble, and reuse these conventional water ride systems.

Additionally, most conventional water amusement systems, such as water slides, often require large volumes of water, further increasing the difficulty of making such systems portable/modular. For example, many water slide systems require large amounts of water to push riders along the ride or at least require large amounts of water to adequately wet a surface of the slide.

Further, most conventional water slide systems are not easily scalable to be employed as large-scale amusement attractions. For example, many conventional water slide systems are configured to be specifically employed under strict operating parameters, such as strict slope grades, etc. Accordingly, it would be difficult, if not impossible, to expand the scale of such systems and to implement such expanded-scale systems at a variety of different locations with a variety of different environmental constraints.

Still further, most conventional water slide systems are not configured for large numbers of people. In other words, many conventional water slide systems, in addition to the above mentioned shortcomings, are only experienced by a single user at a time, and the experience generally only lasts for a few seconds. For example, conventional water slide systems involve a single person sliding down a single lane/chute before another user can experience the ride. Additionally, the ride down the slide only lasts for a couple of seconds.

SUMMARY

From the foregoing discussion, it should be apparent that a need exists for a slide system. Beneficially, such a slide system would be configurable to be employed on a variety of different inclines and a variety of different transverse grades, would be portable/modular, and would require comparatively less water than conventional slide systems.

The subject matter of the present application has been developed in response to the present state of the art, and in particular, in response to the problems and needs in the art that have not yet been fully solved by currently available slide systems. Accordingly, the present disclosure has been developed to provide a slide system and method that overcome many or all of the above-discussed shortcomings in the art.

Disclosed herein is one embodiment of a system for sliding users down an incline. The slide system includes a plurality of slide segments that are detachably and longitudinally intercoupled, each slide segment having a length, a width, and a sliding surface. The slide system also includes a plurality of transverse arches, each transverse arch spanning at least a portion of the width of one of the slide segments. Still further, the slide system includes a water distribution subsystem that has a water supply interface that is coupleable in water receiving communication with a water source and water routing lines that are coupled in water receiving communication with the water supply interface. The water routing lines are coupled to the plurality of transverse arches and comprise outlets that distribute water transversely across at least the portion of the width of the sliding surface of the slide segments.

According to one implementation, each slide segment of the plurality of slide segments includes lateral bumper pads extending along the length of both lateral sides of each slide segment. In such an implementation, each slide segment of the plurality of slide segments may have one or more divider bumper pads extending along the length of each slide segment, wherein the one or more divider bumper pads transversely divide the plurality of slide segments into multiple longitudinal sliding lanes. The outlets of the water routing lines may be spaced apart along the width of the slide segments, with multiple outlets disposed in each longitudinal sliding lane to facilitate proper transverse distribution of water. In one implementation, the outlets may be adjustable flow nozzles to further facilitate proper transverse distribution of water for inclines that have an uneven transverse grade.

According to one implementation, the number of divider bumper pads is two and correspondingly the number of longitudinal sliding lanes is three. In one implementation, each of the plurality of transverse arches spans the width of each slide segment. In another implementation, each of the plurality of transverse arches spans each longitudinal sliding lane. Further, the lateral bumper pads and the plurality of transverse arches may include inflatable chambers that are fluidly coupled to blowers that maintain a positive pressure within the inflatable chambers.

In one implementation, the system also includes a basin segment coupled to a downhill end of the plurality of slide segments. The basin segment may be configured to retain a pool of water that users slide into after sliding across the plurality of slide segments. The water supply interface of the water distribution subsystem may be a pump that pumps water from the pool of water in the basin segment to the water routing lines. In one implementation, the water distribution subsystem includes a manifold that is fluidly coupled downstream of the water supply interface. The manifold may divide and condition the water for longitudinal distribution along a total length of the plurality of slide segments via the water routing lines. The manifold may be disposed at an intermediate point along a total length of the plurality of slide segments via the water routing lines.

According to another implementation, the water supply is pumped in a first direction to a first plurality of nozzles and in a second direction to a second plurality of nozzles. In one implementation, the transverse arches are spaced apart substantially uniformly along the total length of the plurality of slide segments. In one implementation, the water routing lines are configured to deliver a comparatively larger volume of water to an uphill end of the plurality of slide segments. The water routing lines that are configured to deliver water to the uphill end of the plurality of slide segments may have an inner tube diameter that is greater than an inner tube diameter of all other water routing lines. In a further implementation, the system may include a padded underlayer that underlies at least a portion of the plurality of slide segments. The incline may have a grade percent of between about 3.5% and 45%.

Also disclosed herein is another embodiment of a system for sliding users down an incline. The system includes a plurality of slide segments that are detachably and longitudinally inter-coupled. Each slide segment has a length, a width, and a sliding surface and each slide segment of the plurality of slide segments has lateral bumper pads extending along the length of both lateral sides of each slide segment. Each slide segment further has one or more divider bumper pads extending along the length of each slide segment, wherein the one or more divider bumper pads transversely divide the plurality of slide segments into multiple longitudinal sliding lanes.

The embodiment of the system further includes a plurality of transverse arches, with each transverse arch spanning at least a portion of the width of one of the slide segments. Imposts of each transverse arch may be coupled to the slide segments, with each of the plurality of transverse arches spanning the width of each slide segment. The lateral bumper pads, the divider bumper pads, and the plurality of transverse arches may include inflatable chambers that are fluidly coupled to blowers that maintain a positive pressure within the inflatable chambers.

Still further, the embodiment of the system includes a water distribution subsystem that includes a water supply interface that is coupleable in water receiving communication with a water source and water routing lines that are coupled in water receiving communication with the water supply interface. According to one implementation, the water distribution subsystem includes a manifold fluidly coupled downstream of the water supply interface. Further, the manifold divides and conditions the water for longitudinal distribution along a total length of the plurality of slide segments via the water routing lines, with the water routing lines being coupled to the plurality of transverse arches. The outlets may be spaced apart along the width of the slide segments, with multiple outlets disposed in each longitudinal sliding lane, to facilitate proper transverse distribution of water.

Reference throughout this specification to features, advantages, or similar language does not imply that all of the features and advantages that may be realized with the present disclosure should be or are in any single embodiment of the invention. Rather, language referring to the features and advantages is understood to mean that a specific feature, advantage, or characteristic described in connection with an embodiment is included in at least one embodiment of the subject matter disclosed herein. Thus, discussion of the features and advantages, and similar language, throughout this specification may, but do not necessarily, refer to the same embodiment.

Furthermore, the described features, advantages, and characteristics of the disclosure may be combined in any suitable manner in one or more embodiments. One skilled in the relevant art will recognize that the subject matter of the present application may be practiced without one or more of the specific features or advantages of a particular embodiment. In other instances, additional features and advantages may be recognized in certain embodiments that may not be present in all embodiments of the disclosure. Further, in some instances, well-known structures, materials, or operations are not shown or described in detail to avoid obscuring aspects of the subject matter of the present disclosure. These features and advantages of the present disclosure will become more fully apparent from the following description and appended claims, or may be learned by the practice of the disclosure as set forth hereinafter.

BRIEF DESCRIPTION OF THE DRAWINGS

In order that the advantages of the disclosure will be readily understood, a more particular description of the disclosure briefly described above will be rendered by reference to specific embodiments that are illustrated in the appended drawings. Understanding that these drawings depict only typical embodiments of the disclosure and are not therefore to be considered to be limiting of its scope, the subject matter of the present application will be described and explained with additional specificity and detail through the use of the accompanying drawings, in which.

DETAILED DESCRIPTION

Reference throughout this specification to "one embodiment," "an embodiment," or similar language means that a particular feature, structure, or characteristic described in connection with the embodiment is included in at least one embodiment of the present disclosure. Thus, appearances of the phrases "in one embodiment," "in an embodiment," and similar language throughout this specification may, but do not necessarily, all refer to the same embodiment. Similarly, the use of the term "implementation" means an implementation having a particular feature, structure, or characteristic described in connection with one or more embodiments of the present disclosure, however, absent an express correlation to indicate otherwise, an implementation may be associated with one or more embodiments.

Furthermore, the described features, structures, or characteristics of the disclosure may be combined in any suitable manner in one or more embodiments. In the following description, numerous specific details are provided. One skilled in the relevant art will recognize, however, that the subject matter of the present application may be practiced without one or more of the specific details, or with other methods, components, materials, and so forth. In other instances, well-known structures, materials, or operations are not shown or described in detail to avoid obscuring aspects of the disclosure.

Figure 1:
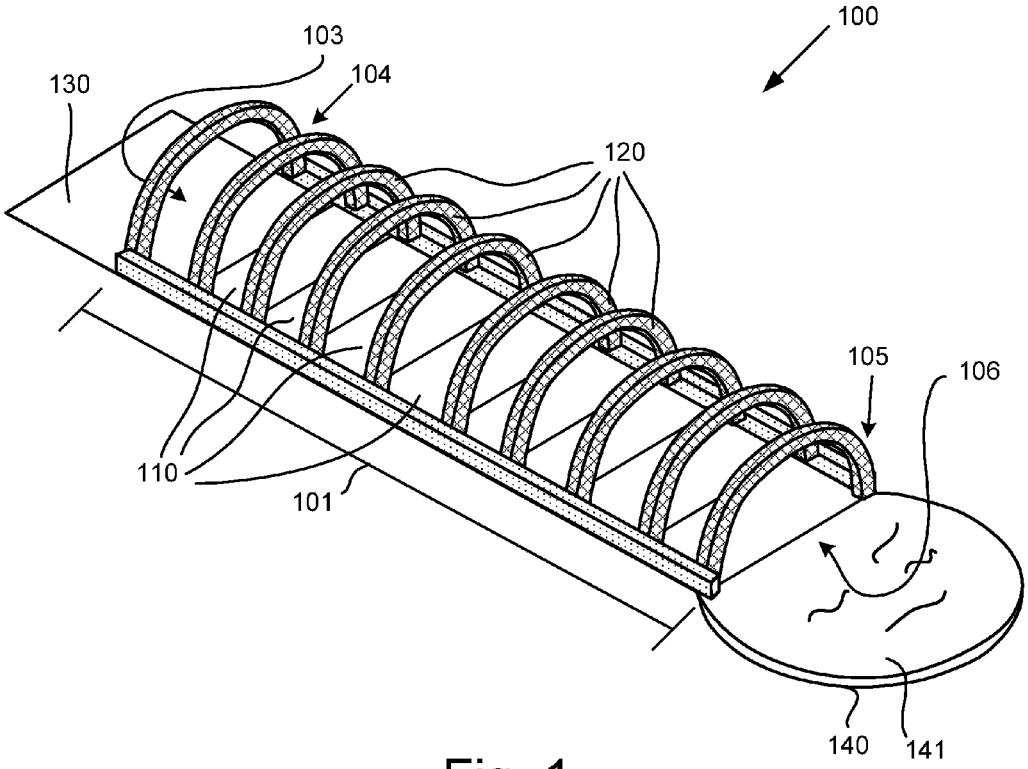
FIG. 1 is a schematic perspective view of a slide system, according to one embodiment.

FIG. 1 is a schematic perspective view of a slide system 100, according to one embodiment. The slide system 100 includes a plurality of slide segments 110, a plurality of transverse arches 120, and a water distribution subsystem (not depicted, discussed in greater detail below with reference to remaining figures). Generally, the slide system 100 may be implemented on a variety of inclined surfaces, such as streets, hills, etc. The slide system has a modular design in that the plurality of slide segments 110 are longitudinally (i.e., end-to-end) intercoupleable so that the overall length 101 of the slide can be selected according to specifics of a given application or according to environmental constraints. In certain embodiments, the slide system 100 may also include a launching segment 130 at an uphill end 104 of the slide segments 110 where users can prepare for their entrance 103 onto the slide segments 110. The slide system 100 may also include a basin segment 140 at a downhill end 105 of the slide segments 110 that contains a volume 141 for catching users that pass through the exit 106 of the slide segments 110 (where the users finish their slide).

In one embodiment, sand-bags or similar weights may be placed on certain regions of the slide to hold the slide in place on the incline and prevent the slide system 100 from inadvertently slipping down the incline. For example, in one embodiment the slide segments 110 may include an integrated pouch or a flap within which or upon which a weight may be placed to secure the slide segments 110 against the incline. In one embodiment, multiple sand-bags (e.g., 30 pound sand-bags) may be used to anchor each slide segment. In another embodiment, the slide system 100 may include stakes or other anchoring elements that can be driven into the incline surface and tethered/coupled to the slide components to anchor the slide system 100 in place.

In one embodiment, for example, the slide system of the present disclosure can be implemented on a municipal street/road. As described in greater detail below, the total length 101 of the plurality of slide segments 110 (i.e., the length of the slide) can be selected according to the specific space constrains of the incline on which the slide system is assembled. In one embodiment, the total length 101 of the slide segments 110 (excluding the length of the optional launch segment 130 and the basin segment 140) may be between about 100 feet and about 3,000 feet. In another embodiment, the total length 101 of the slide segments 110 may be between about 500 feet and 1,500 feet. In yet another embodiment, the total length 101 may be about 1,000 feet. These ranges are exemplary and it is contemplated that other lengths, whether shorter or longer, may be implemented using the disclosed slide system.

The grade of the incline, for example and according to one embodiment, may be between about 3.5% and 45%. In other words, the incline upon which the slide system is assembled may have a vertical drop between about 3.5 feet and 45 feet for every 100 feet of horizontal run of the slide. In another embodiment, the grade of the incline is between about 10% and 30%. In yet another embodiment, the grade of the incline is about 14%. The term "grade" refers to the overall, average slope of the slide. In other words, the incline may have variations in the local slope/grade but the grade ranges described represent overall/average grade possibilities. These grade ranges are only exemplary and it is expected that slide system may be implemented on other grades. As described below, the water distribution subsystem of the present disclosure improves the installation flexibility of the slide system and allows the slide system to be customized/adapted to different locations and to slide riders/users down a variety of different inclines that have different environmental constraints.

Figure 2:
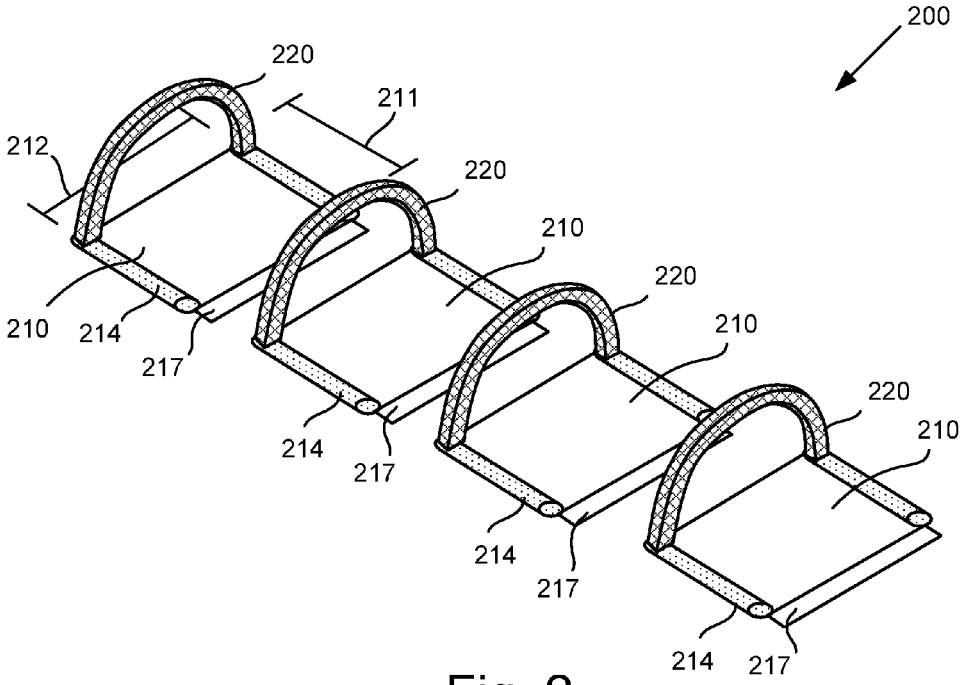
FIG. 2 is a schematic perspective view of a slide system that includes a plurality of slide segments and a plurality of transverse arches, according to one embodiment.

FIG. 2 is a schematic perspective view of a slide system 200 that shows a plurality of slide segments 210 separated a distance from each other and a plurality of transverse arches 220 coupled to the plurality of slide segments 210. Throughout the present disclosure, like numbers (i.e., 110 and 210) generally refer to analogous (if not the same) element, but different reference numerals are used herein because of differences in implementation details/specifications. The slide segments 210 each have a length 211 and a width 212. In one embodiment, each of the slide segments 210 in a slide system 200 has the same length 111 and width 112. In other words, the slide system 200 may include a plurality of uniform slide segments 210. For example, the length 211 of each slide segment 210 may be between about 25 feet long and about 200 feet. In another embodiment, the length 211 of each slide segment 210 may be between about 50 feet and 150 feet. In yet another embodiment, the length 211 of each slide segment 210 may be about 100 feet. In another embodiment, for example, the length of one of the slide segments may be different from the length of another slide segment.

Further, it is contemplated (though not depicted in the figures) that the width of the slide segments may not be uniform along the total length of the slide system. In other words, the slide segments may be configured to have a gradually increasing or decreasing width, thus forming a triangular sliding surface that either narrows at the end of the slide or widens at the end of the slide. In another embodiment, a certain portion of the slide segments may have a first width and a second portion of the slide segments may have a second width. In such a system, users may choose to initiate their slide/ride at the top of the slide and other users, such as children or others, may choose to initiate their slide/ride at a middle point where the slide segments have a wider width, thus essentially creating an extra lane/side of the slide that has a shorter overall slide length. The width 212 of the slide segments 210 affects the number of people that can slide at the same time. While it is contemplated that in certain applications riders may form longitudinal chains of people for sliding down the slide at the same time, the width 212 of the slide segments 210 can influence how many people can go down the slide at one time (i.e., one rider at a time or multiple people in a group sliding at once). In one embodiment, the width 212 of each slide segment 210 may be between about 3 feet and 100 feet or more. In another embodiment, the width 212 of each slide segment 210 may be between about 10 feet and about 50 feet. In yet another embodiment, the width 212 of each slide segment 210 may be about 24 feet.

The slide segments 210 may be coupled together in variety of manners. As shown and according to one embodiment, each slide segment may include an overlapping flap 217 that couples to an overlaps (or underlaps) a portion of an adjacent slide segment. In one embodiment, the overlapping flap 217 may extend from a lower/downhill end of the slide segments 210 and this flap 217 may be positioned underneath or on top of the upper/uphill end of each of the downhill adjacent segments. The flaps 217 may be integrated into each slide segment 210 or may be detachably coupled to each slide segment 210. Additionally, the junction/connection between adjacent slide segments may be facilitated by the use of hook and loop type fastening means (e.g., Velcro), straps, zippers, ties, and/or other coupling devices/elements.

The slide segments 210 may include lateral bumper pads 214 that extend along lateral sides of each slide segment. The lateral bumper pads 214 provide barriers that prevent water and/or users from sliding laterally off of the slide. The lateral bumper pads 214, according to one embodiment, may be separate/independent from the slide segments 210. In another embodiment, the lateral bumper pads 214 may be detachably coupled to the slide segments via fasteners and other coupling means. In yet another embodiment, the lateral bumper pads 214 may be permanently integrated (i.e., sewn/bonded) to the slide segments 210. Additional details regarding the structure and material of the bumper pads are included below with reference to FIG. 6.

The slide segments 210 also include a plurality of transverse arches 220 that are coupled to the slide segments 210. The transverse arches 220 may provide a degree of structural support to the slide system 200 and may facilitate maintaining the sliding surface (top surface) of the slide segments substantially smooth and/or substantially unwrinkled. For example, if the transverse arches were omitted, in certain applications the slide segments would bunch up or the lateral bumper pads 214 would begin to be pulled inward as users slide the length of the slide. However, the transverse arches 220 may partially prevent the lateral bumper pads from being pulled inward and may help to maintain the proper configuration/orientation of the slide segments 210. The transverse arches 220 also facilitate the proper transverse distribution of water across the width 212 of the slide (described in detail below with reference to FIGS. 6-7B).

The transverse arches 220 span at least a portion of the width 212 of each slide segment. In other words, each transverse arch 220 may span the entire width of the slide segments 210, as depicted, or one of the transverse arches may be coupled to the slide segments 210 at intermediate points along the width 212 of each slide segment 210. In one embodiment, as described in greater detail below with reference to FIG. 6, the transverse arches 220 may be detachably coupled to the slide segments 210 or may be permanently integrated with the slide segments 210. Additionally, the transverse arches 220 may be detachably coupled to the lateral bumper pads 214 or may be permanently integrated with the lateral bumper pads 214.

Figure 3:
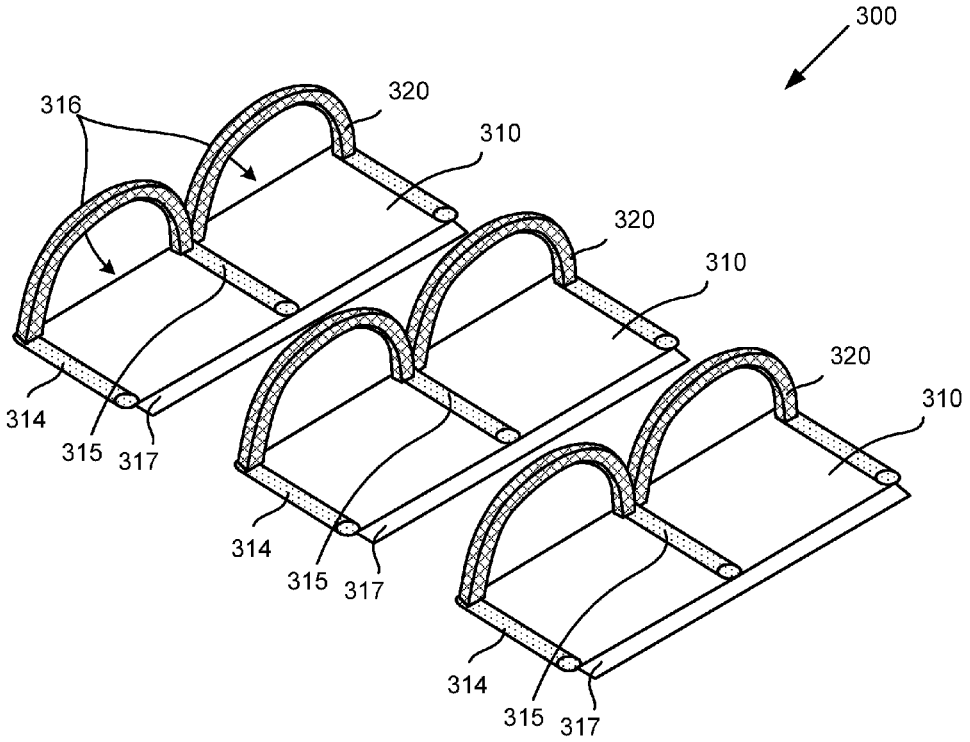
FIG. 3 is another embodiment of a schematic perspective view of a slide system that includes a plurality of slide segments and a plurality of transverse arches.

FIG. 3 is another embodiment of a schematic perspective view of a slide system 300 that includes a plurality of slide segments 310 and a plurality of transverse arches 320. In the depicted embodiment of the slide system 300, each slide segment 310, once again shown spaced apart from other slide segments, has a divider bumper pad 315 that is positioned laterally intermediate the two lateral bumper pads 314. The divider bumper pad 315, which may be coupled to the slide segment 310 in the manners described above with reference to the lateral bumper pads 214, divide the sliding surface of the slide segments 310 into two sliding lanes 316. While a single divider bumper pad 315 is shown in FIG. 3, it is contemplated that more than one divider bumper pad may be implemented, thus creating multiple slide lanes. The sliding lanes 316 may help to usher more users down the slide. Additionally, the creation of multiple sliding lanes 316 allows different lanes to be used for different purposes or for different types/groups of sliders. For example, one lane may be for children, one lane may be for large groups to slide at once, and one lane may be for single riders, etc.

As shown, the transverse arches 320, according to one embodiment, may extend across individual sliding lanes 316. In another embodiment, the transverse arches 320 may span across all the sliding lanes 316 (FIGS. 5-7B). Also, in FIGS. 2 and 3 the transverse arches are depicted as being coupled to each slide segment at an uphill end of each slide segment. However, the longitudinal position of each transverse arch along the length of each slide segment may vary. In one embodiment, the transverse arches may be coupled to each segment at a position, for example, near the middle of the length of the segment or the transverse arch may be coupled at a downhill end of each segment. Further, when arches only span individual lanes (instead of spanning the entire width of the slide) the arches may be aligned with each other or the arches may not be aligned with each other. In other words, one sliding lane may have a transverse arch at an uphill end of the slide segment while another sliding lane of the same segment may have a transverse arch coupled at a middle or downhill portion of the slide segment. In one embodiment, each slide segment has at least one transverse arch. In another embodiment, some of the slide segments may not have a transverse arch.

In another embodiment, it is contemplated that multiple adjacent sliding lanes may be created by positioning two otherwise independent sets of slide segments laterally adjacent to each other. In other words, multiple sliding lanes may be created by using multiple sets of slide segments that are merely positioned next to each other or that are laterally coupled or fastened together. In such an embodiment, the "divider bumper pad" may actually be two lateral bumper pads from laterally adjacent slide segments. As described in greater detail below, each set of slide segments may have its own water distribution subsystem or a single water distribution subsystem may be implemented to distribute water to both sets of slide segments.

Figure 4:
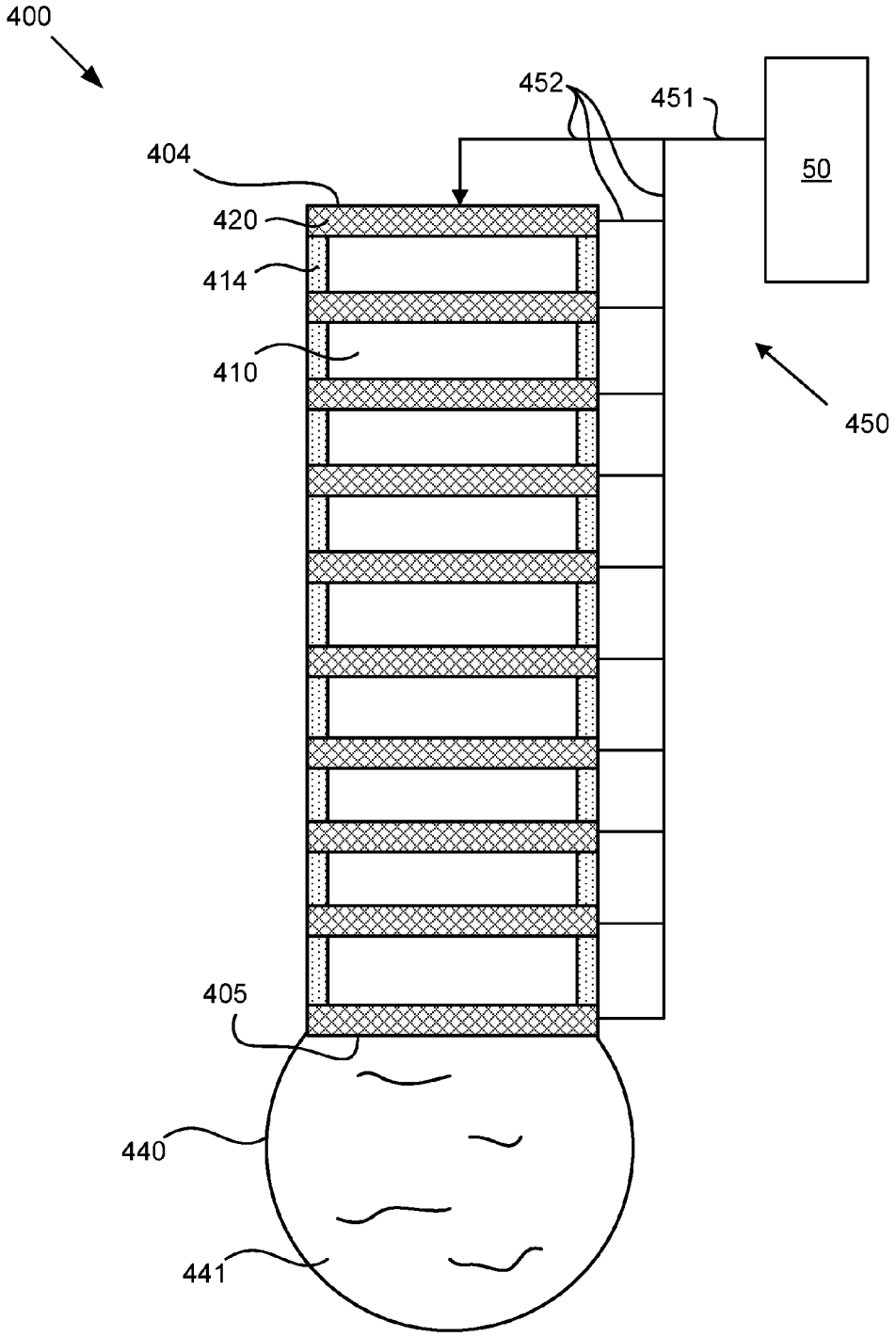
FIG. 4 is a top schematic view of a slide system that shows a water distribution subsystem, according to one embodiment.

FIG. 4 is a top schematic view of a slide system 400 that shows a water distribution subsystem 450, according to one embodiment. The water distribution subsystem 450 includes a water supply interface 451 and water routing lines 452. In the depicted embodiment, a water source 50 is shown and the water supply interface 451 is coupled in fluid receiving communication with the water source 50. The water source 50 may be a batch source, such as a tank or a vessel of water, or the water source 50 may be a continuous source, such as a fire hydrant or other flowing water source. In one embodiment, the water routing lines 452 may direct water down the slide segments 410 from the top/uphill end 404 of the slide segments 410. The water routing lines 452 may also branch out and be coupled to the plurality of transverse arches 420. In such a configuration, the longitudinal spacing of the transverse arches along the total length of the slide provides for longitudinal distribution of water and the span of the transverse arches provide transverse distribution of water. In another embodiment, multiple water sources may be used, depending on the overall size and scale of the slide system. Further, it is contemplated that secondary water sources, such as water trucks, etc., may be employed to further facilitate the proper distribution of water.

It should be noted that the relative scale/proportion of the schematic depictions in the figures is not necessarily representative an actual embodiment of a system. For example, it is contemplated that the length of each slide segment (e.g., the length between transverse arches) may be substantially greater (e.g., four times greater) than the width of each slide segment. In other words, the scale of the schematic depictions should not be construed as limiting the scope of the disclosure.

Figure 5:
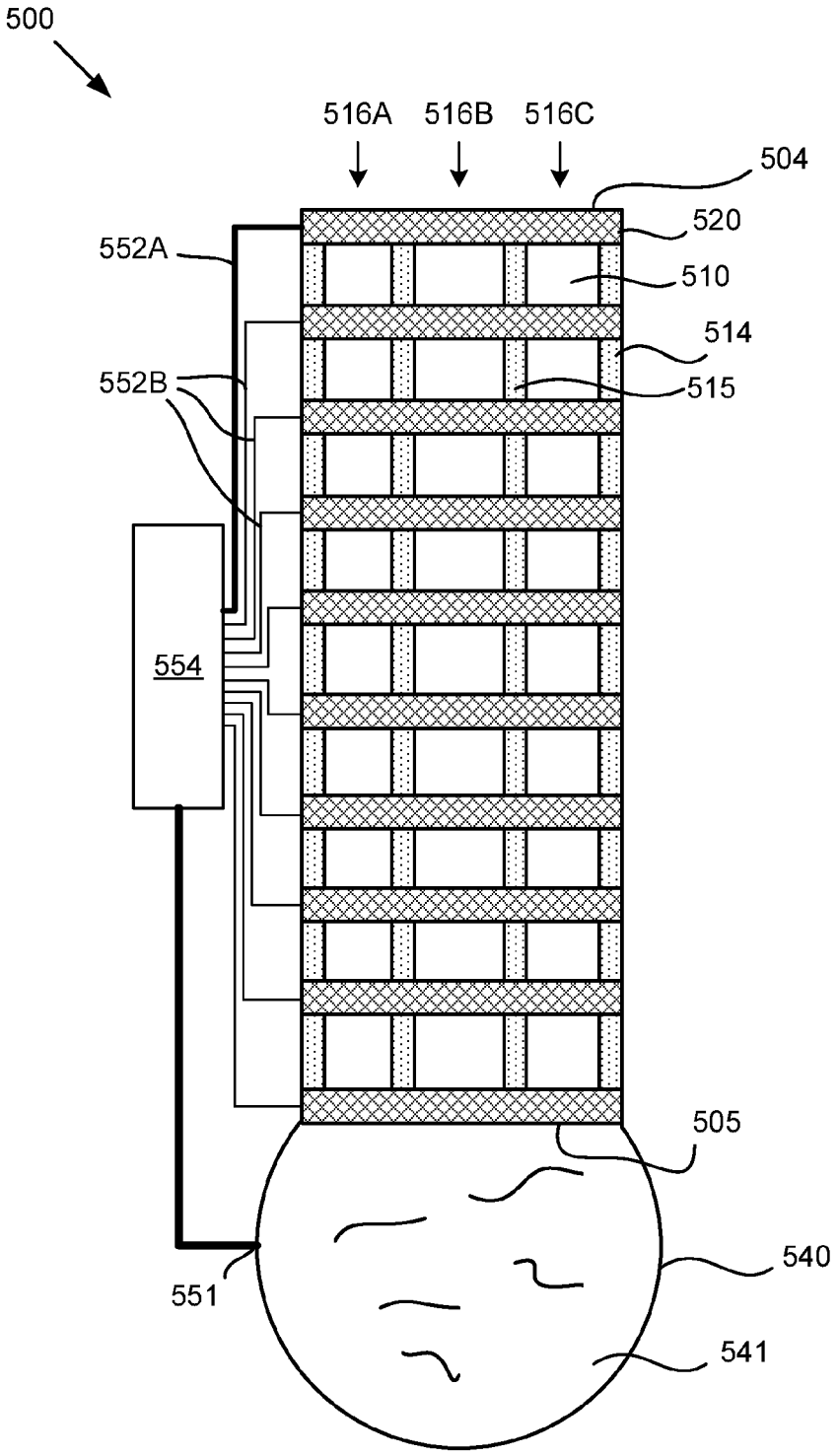
FIG. 5 is a top schematic view a slide system that shows a water distribution subsystem that includes a manifold and water routing lines and multiple sliding lanes formed by divider bumpers of the slide segments, according to one embodiment.

FIG. 5 is a top schematic view a slide system 500 that shows another embodiment of the water distribution subsystem 550 that includes a manifold 554 and water routing lines 552 and multiple sliding 516A, 516B, 516C lanes formed by divider bumper pads 515 (and lateral bumper pads 514) of the slide segments 510. As described above, multiple slide lanes 516A, 516B, 516C may be used to allow for different purposes, different user ages, or for different styles of sliding. As depicted and according to one embodiment, the transverse arches 520 span the entire width of each segment 510 and the water routing lines 552, which are coupled to the transverse arches 520, provide water distribution to each of the sliding lanes 516A, 516B, 516C. Additional details regarding the transverse water distribution across the transverse arches are included below with reference to FIGS. 6-7B.

The manifold 554 generally facilitates in providing the proper longitudinal distribution of water. In one embodiment, the water source may be the volume of water 541 in the basin segment 540. In other words, upon assembling the slide system, the basin segment 540 may be charged with a volume of water 541 that functions as the catch pool that catches all users upon exiting the slide at the downhill end 505 of the slide segments and also functions as the recirculated water source for the water distribution subsystem 550. In such an embodiment, the water supply interface 551 may be a pump or other fluid receiving device/coupling that moves water from the source (e.g., the basin segment 540) to the manifold 554.

The manifold, according to one embodiment, divides the water into flows that are routed, via the water routing lines 552, to each of the transverse arches 520. In one embodiment, the manifold may include pressure and/or flow controls that further regulate and control the conditions/properties of the water flowing to each of the transverse arches. For example, in one embodiment a comparatively larger volume/flow rate of water is routed to the top/uphill end 504 of the slide segments than to the other longitudinal positions (arches). The larger volume/flow rate may be achieved by having routing lines 552 that have different diameters. In one example, the water supply interface 551 that is upstream of the manifold 554 has the comparatively largest diameter (e.g., about 4 inches). Continuing the example, the diameter of the water routing line to the uphill end 50 of the slide segments may be smaller than the water supply interface 551 (e.g., about 2 inches) but may be larger than the remaining water routing lines (e.g., about 1 inch). In one embodiment, the pump of the water supply interface 551 and/or the manifold may be controlled/regulated to alter the pressure/flow rate of water based on the overall incline and based on local inline variations. For example, if a top number of slide segments has a comparatively steeper incline than a bottom portion of slide segments, the water directed to the slide segments may be adjusted accordingly (less water may be needed for steeper inclines). In one embodiment, the transverse arches are uniformly spaced apart so as to improve the longitudinal distribution of water.

Figure 6:
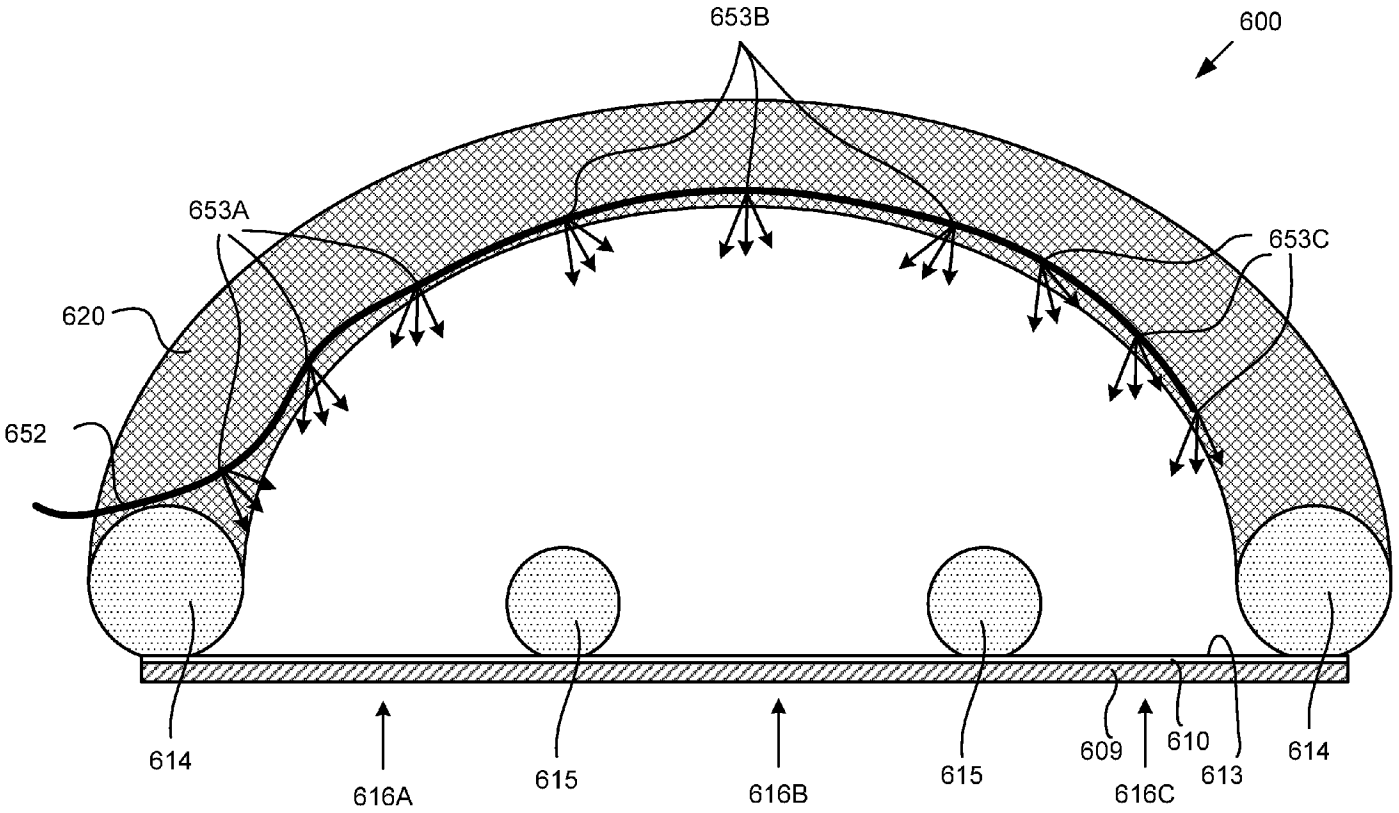
FIG. 6 is a front schematic view of a slide system that shows a water routing line coupled to a transverse arch, according to one embodiment.

FIG. 6 is a front schematic view of a slide system 600 that shows a water routing line 652 coupled to a transverse arch 620, according to one embodiment. FIG. 6 schematically shows a cross-section of the bumper pads (lateral 614 and divider 615) and a cross-section of the slide segment 610 and an underlayer 609. As described above, since the slide system may be implemented on hard surfaces, such as streets or roads, the system also may include an underlayer 609 that protects the slide segments 610 from wear. Additionally, the underlayer 609 may include padding that increases the comfort of the users as they slide down the slide segments 610.

As introduced above, the bumper pads 614, 615 generally divide and control the flow of water and users down the slide. The cross-section, shape, and size of the bumper pads may be selected according to the specifics of a given application. For example, in one embodiment, the lateral bumper pads 614 may be comparatively larger than the divider bumper pads 615 (as depicted). In another embodiment, the sizes and specifications of the bumper pads 614, 615 may be the same. In one embodiment, the bumper pads 614, 615, in conjunction with the transverse arches, may include inflatable chambers that are coupled to (or at least coupleable with) blowers that operably maintain a positive pressure within the inflatable chambers. In other words, the bumper pads and/or the transverse arches may be inflatable structures that are easily collapsed for transport and/or storage. Accordingly, the slide system may also include a plurality of blowers and the bumper pads and/or arches may include a variety of air supply shoots that extend from the slide and are fluidly coupled to the blowers. It is contemplated that the bumper pads and/or transverse arches may be constructed from other materials or may have other structural details. For example, the structure of the bumper pads may be constructed from foam or other padding-like material and the transverse arches may be rigid scaffolding or other temporary rigid structure.

As introduced above, the transverse arches facilitate the proper transverse distribution of water across the width of the slide segments. The water routing lines 652 may be coupled to the exterior of the transverse arches via straps or other fastening means. In another embodiment, the water routing lines 652 may be coupled internally to each of the arches. Generally, the water routing lines 652 include at least one outlet 653 disposed above each sliding lane 616A, 616B, 616C. In one specific embodiment, each sliding lane 616A, 616B, 616C has multiple outlets 653A, 653B, 653C that further facilitate the proper transverse distribution of water. The outlets 653A, 653B, 653C may be nozzles that allow for the flow-rate, pressure, and/or direction of the water to be controlled (see FIGS. 7A and 7B).

Figure 7A:
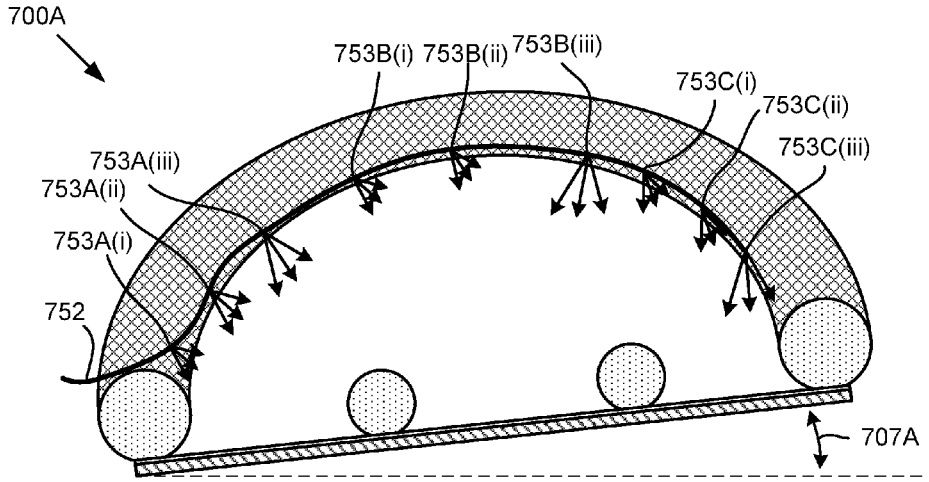
FIG. 7A is a front schematic view of a slide system positioned on an uneven transverse grade, according to one embodiment.
Figure 7B:
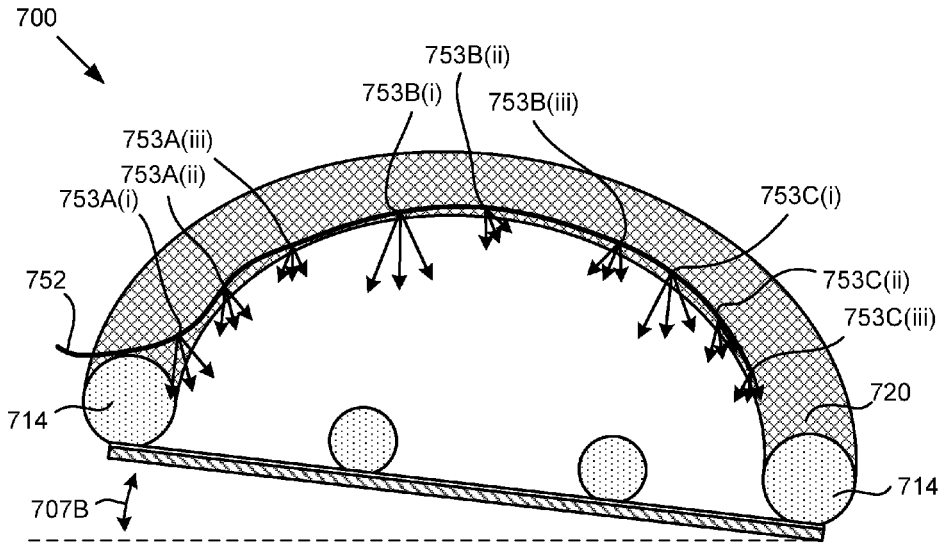
FIG. 7B is a front schematic view of the slide system of FIG. 7A but positioned on an uneven transverse grade with an opposite slope, according to one embodiment.

FIG. 7A is a front schematic view of a slide system 700 positioned on an uneven transverse grade 707A, according to one embodiment and FIG. 7B is the same slide system 700 but showing an oppositely sloped uneven transverse grade 707B. In the depicted embodiments, the transverse grade 707A, 707B has been exaggerated to show how water distribution is affected by uneven transverse grades. As previously mentioned, the slide system may be used on inclines such as streets or roads. Most inclined surfaces are not perfectly level in the transverse direction. For example, most roads are intentionally convexly curved to promote proper rain water runoff. In such configurations, without the proper transverse water distribution, all of the water flowing down a slide would collect on one side of each sliding lane and users would either be prevented from sliding at the speed they want and/or would be unable to use the full width/space of the slide segments.

Accordingly, the water distribution subsystem of the present disclosure solves such problems. Specifically, according to one embodiment, the water distribution subsystem 750 has water routing lines 752 that have multiple outlets 753 in each lane (as described above in FIG. 6). In one embodiment, each of these outlets allow for direction and/or magnitude of water to be controlled (or at least shut off), thereby providing the administrator of the slide system with the ability to regulate and control the transverse distribution of water, as represented in FIGS. 7A and 7B with the arrows from each outlet that have different magnitudes. For example, either the direction or magnitude, according to one example, of the outlets in each sliding lane may configured so as to distribute a comparatively larger volume of water at an upward side (laterally) of the sliding lane. Thus, with reference to FIG. 7A, outlets 753A(iii), 753B(iii) and 753C(iii) may direct a comparatively larger volume of water to the upward side of each sliding lane than the remaining outlets (and vice-versa in FIG. 7B with the opposite transverse grade).

In one embodiment, the outlets 753 are not configured to maintain proper transverse distribution of water across the entire length of slide segment that follows. In other words, in the absence of users sliding down the slide segments, a distance after the transverse arch, the water may still begin to accumulate on the downward side of each sliding lane. However, the controlled transverse distribution of water at each arch, together with the momentum of the slider/user, allows riders to take advantage of and slide across a comparatively larger portion of the sliding surface than if the transverse distribution via the outlets of the water routing lines were not included.

Figure 8:
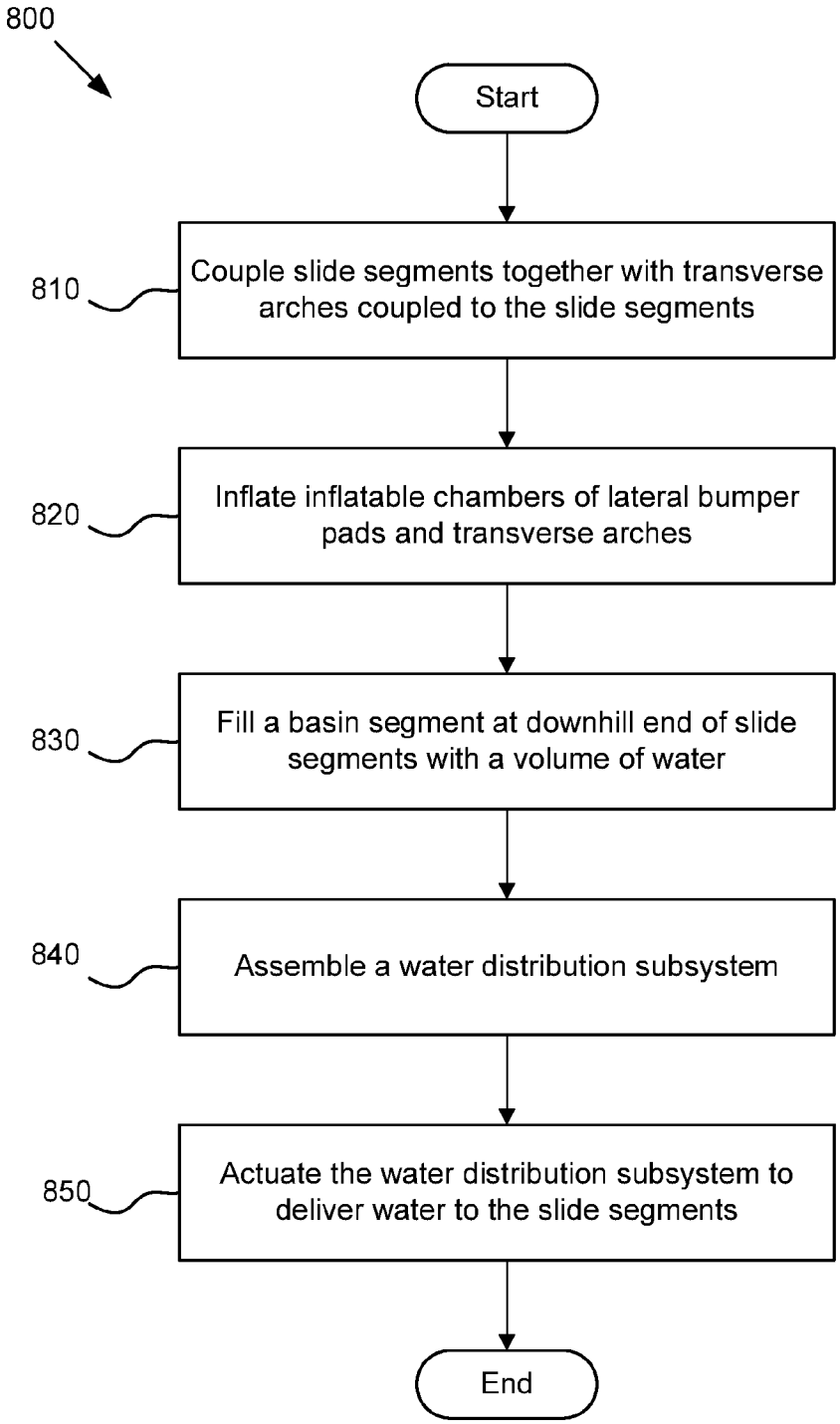
FIG. 8 is a schematic flow chart diagram of a method for assembling a slide system, according to one embodiment.

FIG. 8 is a schematic flow chart diagram of a method 800 for assembling a slide system, according to one embodiment. The method 800 includes coupling a plurality of slide segments end-to-end along the incline at 810, with a basin segment coupled at a downhill end of the plurality of slide segments. In one embodiment, the plurality of slide segments includes lateral bumper pads and a plurality of transverse arches that are coupled to the slide segments. The method 800 further includes inflating inflatable chambers of the lateral bumper pads and the plurality of transverse arches at 820. The method 800 also includes filling the basin segment with a volume of water at 830 and assembling the water distribution subsystem at 840. The water distribution subsystem includes the water supply interface, the manifold, and the water routing lines. In one embodiment, assembling the water distribution subsystem includes positioning the water supply interface in fluid engagement with the volume of water in the basin segment, fluid coupling the manifold between the water supply interface and the water routing lines, and coupling the water routing lines to the plurality of transverse arches. The method 800 further includes actuating the water distribution subsystem to deliver water to the plurality of slide segments at 850.

The schematic flow chart diagrams included herein are generally set forth as logical flow chart diagrams. As such, the depicted order and labeled steps are indicative of one embodiment of the presented method. Other steps and methods may be conceived that are equivalent in function, logic, or effect to one or more steps, or portions thereof, of the illustrated method. Additionally, the format and symbols employed are provided to explain the logical steps of the method and are understood not to limit the scope of the method. Although various arrow types and line types may be employed in the flow chart diagrams, they are understood not to limit the scope of the corresponding method. Indeed, some arrows or other connectors may be used to indicate only the logical flow of the method. For instance, an arrow may indicate a waiting or monitoring period of unspecified duration between enumerated steps of the depicted method. Additionally, the order in which a particular method occurs may or may not strictly adhere to the order of the corresponding steps shown.

In the above description, certain terms may be used such as "up," "down," "upper," "lower," "horizontal," "vertical," "left," "right," and the like. These terms are used, where applicable, to provide some clarity of description when dealing with relative relationships. But, these terms are not intended to imply absolute relationships, positions, and/or orientations. For example, with respect to an object, an "upper" surface can become a "lower" surface simply by turning the object over. Nevertheless, it is still the same object. Further, the terms "including," "comprising," "having," and variations thereof mean "including but not limited to" unless expressly specified otherwise. An enumerated listing of items does not imply that any or all of the items are mutually exclusive and/or mutually inclusive, unless expressly specified otherwise. The terms "a," "an," and "the" also refer to "one or more" unless expressly specified otherwise. Further, the term "plurality" can be defined as "at least two."

Additionally, instances in this specification where one element is "coupled" to another element can include direct and indirect coupling. Direct coupling can be defined as one element coupled to and in some contact with another element. Indirect coupling can be defined as coupling between two elements not in direct contact with each other, but having one or more additional elements between the coupled elements. Further, as used herein, securing one element to another element can include direct securing and indirect securing. Additionally, as used herein, "adjacent" does not necessarily denote contact. For example, one element can be adjacent another element without being in contact with that element.

As used herein, the phrase "at least one of", when used with a list of items, means different combinations of one or more of the listed items may be used and only one of the items in the list may be needed. The item may be a particular object, thing, or category. In other words, "at least one of" means any combination of items or number of items may be used from the list, but not all of the items in the list may be required. For example, "at least one of item A, item B, and item C" may mean item A; item A and item B; item B; item A, item B, and item C; or item B and item C. In some cases, "at least one of item A, item B, and item C" may mean, for example, without limitation, two of item A, one of item B, and ten of item C; four of item B and seven of item C; or some other suitable combination.

Unless otherwise indicated, the terms "first," "second," etc. are used herein merely as labels, and are not intended to impose ordinal, positional, or hierarchical requirements on the items to which these terms refer. Moreover, reference to, e.g., a "second" item does not require or preclude the existence of, e.g., a "first" or lower-numbered item, and/or, e.g., a "third" or higher-numbered item.

The subject matter of the present disclosure may be embodied in other specific forms without departing from its spirit or essential characteristics. The described embodiments are to be considered in all respects only as illustrative and not restrictive. The scope of the disclosure is, therefore, indicated by the appended claims rather than by the foregoing description. All changes which come within the meaning and range of equivalency of the claims are to be embraced within their scope.

What is claimed is:

1. A system for sliding users down an incline, comprising:

a plurality of slide segments that are detachably and longitudinally inter-coupled, each slide segment having a length, a width, and a sliding surface, wherein each slide segment of the plurality of slide segments comprises lateral bumper pads extending along the length of both lateral sides of each slide segment and one or more divider bumper pads extending along the length of each slide segment, wherein the one or more divider bumper pads transversely divide the plurality of slide segments into multiple longitudinal sliding lanes;

a plurality of transverse arches, each transverse arch spanning at least a portion of the width of one of the slide segments; and a water distribution subsystem comprising a water supply interface that is coupleable in water receiving communication with a water source and water routing lines that are coupled in water receiving communication with the water supply interface, wherein the water routing lines are coupled to the plurality of transverse arches and comprise outlets that distribute water transversely across at least the portion of the width of the sliding surface of the slide segments.

2. The system of claim 1, wherein the outlets are spaced apart along the width of the slide segments, with multiple outlets disposed in each longitudinal sliding lane, to facilitate proper transverse distribution of water.

3. The system of claim 2, wherein the outlets comprise adjustable flow nozzles to further facilitate proper transverse distribution of water for inclines that have an uneven transverse grade.

4. The system of claim 1, wherein the number of divider bumper pads is two and correspondingly the number of longitudinal sliding lanes is three.

5. The system of claim 1, wherein each of the plurality of transverse arches spans the width of each slide segment.

6. The system of claim 1, wherein each of the plurality of transverse arches spans each longitudinal sliding lane.

7. The system of claim 1, wherein the lateral bumper pads and the plurality of transverse arches comprise inflatable chambers, wherein the inflatable chambers are fluidly coupled to blowers that maintain a positive pressure within the inflatable chambers.

8. The system of claim 1, further comprising a basin segment coupled to a downhill end of the plurality of slide segments, wherein the basin segment is configured to retain a pool of water that users slide into after sliding across the plurality of slide segments.

9. The system of claim 8, wherein the water supply interface of the water distribution subsystem comprises a pump that pumps water from the pool of water in the basin segment to the water routing lines.

10. The system of claim 1, wherein the water distribution subsystem comprises a manifold fluidly coupled downstream of the water supply interface, wherein the manifold divides and conditions the water for longitudinal distribution along a total length of the plurality of slide segments via the water routing lines.

11. The system of claim 10, wherein the manifold is disposed at an intermediate point along a total length of the plurality of slide segments via the water routing lines.

12. The system of claim 11, further comprising a padded underlayer that underlies at least a portion of the plurality of slide segments.

13. The system of claim 10, wherein the plurality of transverse arches are spaced apart substantially uniformly along the total length of the plurality of slide segments.

14. The system of claim 13, wherein the water routing lines are configured to deliver a comparatively larger volume of water to an uphill end of the plurality of slide segments.

15. The system of claim 10, wherein the water routing lines that are configured to deliver water to the uphill end of the plurality of slide segments have an inner tube diameter that is greater than an inner tube diameter of all other water routing lines.

16. The system of claim 1, wherein the water supply is pumped in a first direction to a first plurality of nozzles and in a second direction to a second plurality of nozzles.

17. The system of claim 1, wherein the incline has a grade percent of between about 3.5% and 45%.

18. A system for sliding users down an incline, comprising:

a plurality of slide segments that are detachably and longitudinally inter-coupled, each slide segment having a length, a width, and a sliding surface, wherein each slide segment of the plurality of slide segments comprises lateral bumper pads extending along the length of both lateral sides of each slide segment and one or more divider bumper pads extending along the length of each slide segment, wherein the one or more divider bumper pads transversely divide the plurality of slide segments into multiple longitudinal sliding lanes;

a plurality of transverse arches, wherein each transverse arch spans at least a portion of the width of one of the slide segments, wherein the imposts of each transverse arch are coupled to the slide segments, wherein each of the plurality of transverse arches spans the width of each slide segment, wherein the lateral bumper pads, the divider bumper pads, and the plurality of transverse arches comprise inflatable chambers, wherein the inflatable chambers are fluidly coupled to blowers that maintain a positive pressure within the inflatable chambers; and a water distribution subsystem comprising a water supply interface that is coupleable in water receiving communication with a water source and water routing lines that are coupled in water receiving communication with the water supply interface, wherein the water distribution subsystem comprises a manifold fluidly coupled downstream of the water supply interface, wherein the manifold divides and conditions the water for longitudinal distribution along a total length of the plurality of slide segments via the water routing lines, wherein the water routing lines are coupled to the plurality of transverse arches, wherein the outlets are spaced apart along the width of the slide segments, with multiple outlets disposed in each longitudinal sliding lane, to facilitate proper transverse distribution of water.

* * * * *